US009289886B2

(12) United States Patent
Limberg et al.

(10) Patent No.: US 9,289,886 B2
(45) Date of Patent: Mar. 22, 2016

(54) IMPACT TOOL WITH ADJUSTABLE CLUTCH

(75) Inventors: Kurt P. Limberg, Milwaukee, WI (US); John S. Scott, Brookfield, WI (US)

(73) Assignee: MILWAUKEE ELECTRIC TOOL CORPORATION, Brookefield, WI (US)

( * ) Notice: Subject to any disclaimer, the term of this patent is extended or adjusted under 35 U.S.C. 154(b) by 881 days.

(21) Appl. No.: 13/281,905

(22) Filed: Oct. 26, 2011

(65) Prior Publication Data

US 2012/0111592 A1 May 10, 2012

Related U.S. Application Data

(60) Provisional application No. 61/410,116, filed on Nov. 4, 2010.

(51) Int. Cl.

| | |
|---|---|
| ***B25B 21/02*** | (2006.01) |
| ***B23B 23/00*** | (2006.01) |
| ***B25B 23/14*** | (2006.01) |

(52) U.S. Cl.

CPC ..... *B25B 21/026* (2013.01); *B25B 23/141* (2013.01); *B25B 23/1405* (2013.01)

(58) Field of Classification Search

CPC ..... B25B 21/00; B25B 21/02; B25B 21/026; B25B 21/008; B25B 23/1405; B25F 5/001; B25F 5/00; B25F 5/02; B25F 5/006; B25F 5/026; B25F 5/003

USPC ..... 173/48, 90, 138, 200–212

See application file for complete search history.

(56) References Cited

U.S. PATENT DOCUMENTS

| | | | |
|---|---|---|---|
| 1,341,700 | A | 6/1920 | Alexander |
| 1,494,891 | A | 5/1924 | Elfe |
| 1,536,157 | A | 5/1925 | Slack |
| 1,750,825 | A | 3/1930 | Thompson |
| 1,811,666 | A | 6/1931 | Foster |
| 1,927,383 | A | 9/1933 | Bardwell |
| 1,970,179 | A | 8/1934 | Miller |
| 2,086,261 | A | 7/1937 | Douglass |

(Continued)

FOREIGN PATENT DOCUMENTS

| | | |
|---|---|---|
| EP | 2210708 | 7/2010 |
| JP | 6320435 | 11/1994 |

OTHER PUBLICATIONS

International Search Report and Written Opinion for Application No. PCT/US2011/057840 dated Jun. 25, 2012 (7 pages).

(Continued)

*Primary Examiner* — Andrew M Tecco
*Assistant Examiner* — Chelsea Stinson
(74) *Attorney, Agent, or Firm* — Michael Best & Friedrich LLP

(57) ABSTRACT

An impact tool includes a housing, a motor supported in the housing, an output shaft rotatably supported in the housing about a central axis, an impact mechanism coupled between the motor and the output shaft and operable to impart a striking rotational force to the output shaft, and a clutch mechanism coupled between the impact mechanism and the output shaft. The clutch mechanism is operable in a first mode, in which torque from the motor is transferred to the output shaft through the impact mechanism, and a second mode, in which torque from the motor is diverted from the output shaft toward a portion of the impact mechanism.

20 Claims, 8 Drawing Sheets

(56) References Cited

U.S. PATENT DOCUMENTS

| | | | |
|---|---|---|---|
| 2,128,761 | A | 8/1938 | Thomas |
| 2,140,223 | A | 12/1938 | Foster |
| 2,143,173 | A | 1/1939 | Shaff |
| 2,160,150 | A | 5/1939 | Jimerson et al. |
| 2,160,622 | A | 5/1939 | Olson et al. |
| 2,196,589 | A | 4/1940 | Jimerson |
| 2,212,919 | A | 8/1940 | Hutchison, Jr. |
| 2,219,865 | A | 10/1940 | Fitch |
| 2,219,869 | A | 10/1940 | Hutchison, Jr. |
| 2,219,883 | A | 10/1940 | Amtsberg |
| 2,261,204 | A | 11/1941 | Amtsberg |
| 2,285,638 | A | 6/1942 | Amtsberg |
| 2,285,639 | A | 6/1942 | Amtsberg |
| 2,326,317 | A | 8/1943 | Amtsberg |
| 2,326,347 | A | 8/1943 | Forss |
| 2,341,497 | A | 2/1944 | Amtsberg |
| 2,342,783 | A | 2/1944 | Aron et al. |
| 2,343,332 | A | 3/1944 | Shaff |
| 2,371,982 | A | 3/1945 | Fitch |
| 2,373,664 | A | 4/1945 | Emery |
| 2,373,665 | A | 4/1945 | Emery |
| 2,396,498 | A | 3/1946 | Fitch |
| 2,408,228 | A | 9/1946 | Richards |
| 2,425,427 | A | 8/1947 | Fitch |
| 2,425,793 | A | 8/1947 | Fosnot |
| 2,440,834 | A | 5/1948 | Sims, Jr. |
| 2,508,997 | A | 5/1950 | Fitch |
| 2,514,914 | A | 7/1950 | Van Sittert |
| 2,515,329 | A | 7/1950 | Bogart |
| 2,520,920 | A | 9/1950 | Fosnot |
| 2,530,915 | A | 11/1950 | Stec |
| 2,533,703 | A | 12/1950 | Wilhide et al. |
| 2,543,979 | A | 3/1951 | Maurer |
| 2,563,711 | A | 8/1951 | Fitch |
| 2,564,224 | A | 8/1951 | Mitchell |
| 2,566,661 | A | 9/1951 | Hamlin |
| 2,575,523 | A | 11/1951 | Mitchell |
| 2,576,851 | A | 11/1951 | Newman |
| 2,578,279 | A | 12/1951 | Bardwell |
| 2,579,278 | A | 12/1951 | Thomas |
| 2,580,607 | A | 1/1952 | Schmid |
| 2,580,631 | A | 1/1952 | Whitledge |
| 2,581,033 | A | 1/1952 | Larson et al. |
| 2,583,147 | A | 1/1952 | Kaplan |
| 2,585,486 | A | 2/1952 | Mitchell |
| 2,586,314 | A | 2/1952 | Emery |
| 2,591,323 | A | 4/1952 | Webb |
| 2,600,495 | A | 6/1952 | Fitch |
| 2,616,322 | A | 11/1952 | Spreng |
| 2,636,410 | A | 4/1953 | Murrill |
| 2,636,583 | A | 4/1953 | Whitledge |
| 2,637,426 | A | 5/1953 | Van Sittert |
| 2,662,434 | A | 12/1953 | Burkhardt |
| 2,684,738 | A | 7/1954 | Kaplan |
| 2,691,434 | A | 10/1954 | Jimerson |
| 2,693,867 | A | 11/1954 | Maurer |
| 2,704,952 | A | 3/1955 | Mooter |
| 2,705,896 | A | 4/1955 | Holmes |
| 2,707,892 | A | 5/1955 | Holmes |
| 2,711,111 | A | 6/1955 | Brame |
| 2,711,661 | A | 6/1955 | Shaff |
| 2,711,662 | A | 6/1955 | Shaff |
| 2,716,475 | A | 8/1955 | Mitchell |
| 2,717,672 | A | 9/1955 | Maurer |
| 2,718,803 | A | 9/1955 | Jimerson |
| 2,720,956 | A | 10/1955 | Coombes |
| 2,725,961 | A | 12/1955 | Maurer |
| 2,727,598 | A | 12/1955 | Mitchell et al. |
| 2,740,508 | A | 4/1956 | Shaff |
| 2,743,637 | A | 5/1956 | Redmon |
| 2,744,431 | A | 5/1956 | Scime |
| 2,745,528 | A | 5/1956 | Amtsberg |
| 2,753,072 | A | 7/1956 | Mitchell |
| 2,753,965 | A | 7/1956 | Kaman |
| 2,756,622 | A | 7/1956 | Belle |
| 2,756,853 | A | 7/1956 | Madsen |
| 2,764,272 | A | 9/1956 | Reynolds |
| 2,768,546 | A | 10/1956 | Amtsberg |
| 2,783,863 | A | 3/1957 | Shaff |
| 2,784,625 | A | 3/1957 | Maurer |
| 2,784,818 | A | 3/1957 | Maurer |
| 2,801,718 | A | 8/1957 | Kaman |
| 2,802,556 | A | 8/1957 | Schmid |
| 2,808,916 | A | 10/1957 | Johnson |
| 2,815,834 | A | 12/1957 | Mall |
| 2,825,436 | A | 3/1958 | Amtsberg |
| 2,836,272 | A | 5/1958 | Kaman |
| 2,842,994 | A | 7/1958 | Stine |
| 2,850,128 | A | 9/1958 | Van Sittert |
| 2,881,884 | A | 4/1959 | Amtsberg |
| 2,881,885 | A | 4/1959 | Short |
| 2,886,997 | A | 5/1959 | Madsen |
| 2,898,791 | A | 8/1959 | Maurer |
| 2,900,856 | A | 8/1959 | Maier |
| 2,903,111 | A | 9/1959 | Young |
| 2,923,191 | A | 2/1960 | Fulop |
| 2,940,556 | A | 6/1960 | Conover, Jr. |
| 2,952,177 | A | 9/1960 | Skillin |
| 2,969,660 | A | 1/1961 | Dale et al. |
| 2,973,068 | A | 2/1961 | Sturrock |
| 2,973,071 | A | 2/1961 | Sturrock |
| 2,974,553 | A | 3/1961 | Donowick |
| 2,978,936 | A | 4/1961 | Orner |
| 2,980,218 | A | 4/1961 | Young |
| 3,000,244 | A | 9/1961 | Sturrock |
| 3,001,428 | A | 9/1961 | Sindelar |
| 3,001,429 | A | 9/1961 | Sindelar |
| 3,012,420 | A | 12/1961 | Schaedler |
| 3,016,774 | A | 1/1962 | Minobe |
| 3,016,775 | A | 1/1962 | Calkins |
| 3,053,360 | A | 9/1962 | Madsen |
| 3,088,445 | A | 5/1963 | Gardner |
| 3,100,558 | A | 8/1963 | Hornschuch |
| 3,102,621 | A | 9/1963 | Van Sittert |
| 3,104,743 | A | 9/1963 | Reynolds |
| 3,106,274 | A | 10/1963 | Madsen |
| 3,108,507 | A | 10/1963 | Quarve |
| 3,129,796 | A | 4/1964 | Karden |
| 3,144,108 | A | 8/1964 | Reynolds |
| 3,144,109 | A | 8/1964 | Alajouanine |
| 3,150,725 | A | 9/1964 | Hornschuch et al. |
| 3,157,074 | A | 11/1964 | Durkee |
| 3,169,585 | A | 2/1965 | Maurer |
| 3,174,597 | A | 3/1965 | Schaedler et al. |
| 3,174,599 | A | 3/1965 | Spyridakis et al. |
| 3,174,606 | A | 3/1965 | Hornschuch et al. |
| 3,180,185 | A | 4/1965 | Schmidt et al. |
| 3,180,435 | A | 4/1965 | McHenry |
| 3,181,672 | A | 5/1965 | Swanson |
| 3,195,704 | A | 7/1965 | Linsker |
| 3,199,644 | A | 8/1965 | Clapp |
| 3,203,283 | A | 8/1965 | Newman |
| 3,207,237 | A | 9/1965 | Wanner |
| 3,208,569 | A | 9/1965 | Adee |
| 3,212,590 | A | 10/1965 | Hoza et al. |
| 3,220,525 | A | 11/1965 | Pauley |
| 3,228,486 | A | 1/1966 | Kaman et al. |
| 3,257,877 | A | 6/1966 | Ulrich et al. |
| 3,269,466 | A | 8/1966 | Mitchell |
| 3,270,593 | A | 9/1966 | Kaman |
| 3,276,524 | A | 10/1966 | Falter |
| 3,294,183 | A | 12/1966 | Riley, Jr. et al. |
| 3,318,390 | A | 5/1967 | Hoza et al. |
| 3,362,486 | A | 1/1968 | Alajouanine |
| 3,369,615 | A | 2/1968 | Maffey, Jr. et al. |
| 3,380,539 | A | 4/1968 | Kaman |
| 3,387,669 | A | 6/1968 | Wise, Jr. et al. |
| 3,389,756 | A | 6/1968 | Kawamoto |
| 3,407,885 | A | 10/1968 | Hoza et al. |
| 3,413,876 | A | 12/1968 | Shinn |
| 3,414,065 | A | 12/1968 | Falter |
| 3,414,066 | A | 12/1968 | Wallace |
| 3,428,137 | A | 2/1969 | Schaedler et al. |
| 3,438,451 | A | 4/1969 | Hayes, Jr. |

(56) References Cited

U.S. PATENT DOCUMENTS 3,450,214 A 6/1969 Bangerter et al.
3,477,521 A 11/1969 Kiester et al.
3,526,282 A 9/1970 Newman
3,552,499 A 1/1971 Maurer
3,557,884 A 1/1971 Allen
3,561,543 A 2/1971 Ulbing
3,572,447 A 3/1971 Pauley
3,578,091 A 5/1971 States
3,581,831 A 6/1971 Biek
3,592,087 A 7/1971 Pauley
3,592,274 A 7/1971 Young
3,605,914 A 9/1971 Kramer
3,606,931 A 9/1971 Karden
3,606,932 A 9/1971 Schoeps
3,608,131 A 9/1971 Hornschuch et al.
3,610,344 A 10/1971 Schoeps et al.
3,643,749 A 2/1972 Pauley
3,648,784 A 3/1972 Schoeps
3,661,040 A 5/1972 Lesner
3,661,217 A 5/1972 Maurer
3,696,693 A 10/1972 Bosten et al.
3,703,933 A 11/1972 Schoeps
3,710,873 A 1/1973 Allen
3,734,205 A 5/1973 Maurer
3,734,515 A 5/1973 Dudek
3,739,659 A 6/1973 Workman, Jr.
3,741,313 A 6/1973 States
3,744,350 A 7/1973 Raff
3,752,278 A 8/1973 States
3,759,119 A 9/1973 Wing
3,759,334 A 9/1973 Theurer
3,774,479 A 11/1973 Lesner
3,780,603 A 12/1973 Whitaker
3,789,934 A 2/1974 Schoeps et al.
3,792,737 A 2/1974 Bratt
3,799,307 A 3/1974 Tate
3,804,180 A 4/1974 Gelfand et al.
3,805,645 A 4/1974 Jenny
3,808,904 A 5/1974 Gotsch et al.
3,828,863 A 8/1974 Bleicher et al.
3,830,316 A 8/1974 Volovich et al.
3,832,916 A 9/1974 Schoeps
3,835,934 A 9/1974 Schoeps et al.
3,847,229 A 11/1974 Wanner et al.
3,868,872 A 3/1975 Wing
3,874,460 A 4/1975 Schmid et al.
3,886,822 A 6/1975 Pauley
3,908,766 A 9/1975 Hess
3,908,768 A 9/1975 Hess
3,918,325 A 11/1975 Frost
3,939,924 A 2/1976 Grabovac
3,948,328 A 4/1976 Hiraoka et al.
3,952,814 A 4/1976 Gelfand et al.
3,955,662 A 5/1976 Thackston
3,960,035 A 6/1976 Workman, Jr. et al.
3,970,151 A 7/1976 Workman, Jr.
3,974,884 A 8/1976 Gidlund
3,990,407 A 11/1976 Parker et al.
4,019,023 A 4/1977 Marzonie et al.
4,055,080 A 10/1977 Farr et al.
4,064,948 A 12/1977 Bratt et al.
4,121,670 A 10/1978 Antipov et al.
4,147,219 A 4/1979 Wallace
4,171,651 A 10/1979 Dacunto
4,183,265 A 1/1980 Pauley
4,185,701 A 1/1980 Boys
4,191,264 A 3/1980 Antipov et al.
4,215,594 A 8/1980 Workman, Jr. et al.
4,232,750 A 11/1980 Antipov et al.
4,243,108 A 1/1981 Galimov et al.
4,265,320 A 5/1981 Tanaka et al.
4,265,347 A 5/1981 Dischler
4,287,956 A 9/1981 Maurer
4,313,505 A 2/1982 Silvern
4,316,512 A 2/1982 Kibblewhite et al.
4,321,973 A 3/1982 Maurer
4,347,902 A 9/1982 Wallace et al.
4,350,213 A 9/1982 Antipov et al.
4,358,735 A 11/1982 Boys
4,379,492 A 4/1983 Hiraoka
4,384,622 A 5/1983 Koziniak
4,418,765 A 12/1983 Mori et al.
4,448,564 A 5/1984 Orszulak
4,460,049 A 7/1984 Shibata
4,462,281 A 7/1984 Zils
4,502,549 A 3/1985 Hornung et al.
4,505,170 A 3/1985 Van Laere
4,535,850 A 8/1985 Alexander
4,544,039 A 10/1985 Crane
4,557,337 A 12/1985 Shibata
4,609,089 A 9/1986 Kobayashi et al.
4,619,162 A 10/1986 Van Laere
4,712,625 A 12/1987 Kress
4,811,797 A 3/1989 Antipov et al.
4,834,192 A 5/1989 Hansson
4,838,364 A 6/1989 Hansson
4,869,131 A 9/1989 Ohmori
4,881,435 A 11/1989 Hansson
4,892,013 A 1/1990 Satoh
4,905,423 A 3/1990 van Laere
4,919,022 A 4/1990 Ono et al.
4,923,047 A 5/1990 Fink et al.
4,966,057 A 10/1990 Koppatsch
4,979,408 A 12/1990 Hayashi
4,991,472 A 2/1991 Hollingsworth
5,011,341 A 4/1991 DeGroff
5,019,023 A 5/1991 Kurosawa
RE33,711 E 10/1991 Ono et al.
5,083,619 A 1/1992 Giardino et al.
5,095,784 A 3/1992 Garver
5,111,889 A 5/1992 Neumaier
5,123,313 A 6/1992 Andersson
5,195,406 A 3/1993 Lindqvist
5,199,505 A 4/1993 Izumisawa
5,269,733 A 12/1993 Anthony, III
5,277,527 A 1/1994 Yokota et al.
5,315,902 A 5/1994 Ragland et al.
5,328,306 A 7/1994 Rehm et al.
5,339,908 A * 8/1994 Yokota et al. ..... 173/216
5,346,022 A 9/1994 Krivec
5,377,769 A 1/1995 Hasuo et al.
5,535,867 A 7/1996 Coccaro et al.
5,544,554 A 8/1996 Brightly
5,544,710 A 8/1996 Groshans et al.
5,558,059 A 9/1996 Yashinaga et al.
5,573,074 A 11/1996 Thames et al.
5,592,396 A 1/1997 Tambini et al.
5,622,230 A 4/1997 Giardino et al.
RE35,617 E 9/1997 Krivec
5,673,758 A 10/1997 Sasaki et al.
5,689,434 A 11/1997 Tambini et al.
5,699,872 A 12/1997 Miyakawa et al.
5,706,902 A 1/1998 Eisenhardt
5,738,177 A 4/1998 Schell et al.
5,740,892 A 4/1998 Huang
5,836,403 A 11/1998 Putney et al.
5,881,855 A 3/1999 Putney et al.
5,887,666 A 3/1999 Chen et al.
5,901,794 A 5/1999 Schoeps et al.
5,941,360 A 8/1999 Putney et al.
5,974,913 A 11/1999 Von Rotz et al.
6,003,618 A 12/1999 Wallace
6,045,303 A 4/2000 Chung
6,047,779 A 4/2000 Wallace
6,062,114 A 5/2000 Rahm
6,076,438 A 6/2000 Rahm
6,102,632 A 8/2000 Potter et al.
6,119,794 A 9/2000 Chen
6,142,243 A 11/2000 Mayer
6,158,526 A 12/2000 Ghode et al.
6,178,853 B1 1/2001 Huang
6,227,308 B1 5/2001 Ghode et al.
6,247,384 B1 6/2001 Kusu et al.
6,283,226 B1 9/2001 Chen

(56) References Cited

U.S. PATENT DOCUMENTS

| | | | |
|---|---|---|---|
| 6,296,427 | B1 | 10/2001 | Potter et al. |
| 6,305,481 | B1 | 10/2001 | Yamazaki et al. |
| 6,311,786 | B1 | 11/2001 | Giardino et al. |
| 6,318,479 | B1 | 11/2001 | Giardino et al. |
| 6,321,853 | B2 | 11/2001 | Giardino et al. |
| 6,354,178 | B2 | 3/2002 | Pool et al. |
| 6,431,289 | B1 | 8/2002 | Potter et al. |
| 6,446,735 | B1 | 9/2002 | Chen |
| 6,457,535 | B1 | 10/2002 | Tanaka |
| 6,461,088 | B2 | 10/2002 | Potter et al. |
| 6,491,111 | B1 | 12/2002 | Livingston et al. |
| 6,502,648 | B2 | 1/2003 | Milbourne |
| 6,523,658 | B2 | 2/2003 | Furuta et al. |
| 6,543,313 | B2 | 4/2003 | Samudosky |
| 6,546,815 | B2 | 4/2003 | Yamada et al. |
| 6,561,284 | B2 | 5/2003 | Taga |
| 6,609,577 | B2 | 8/2003 | Beccu |
| 6,662,882 | B2 | 12/2003 | Hansson |
| 6,672,183 | B2 | 1/2004 | Johnson |
| 6,676,557 | B2 | 1/2004 | Milbourne et al. |
| 6,708,779 | B2 | 3/2004 | Tagai |
| 6,719,067 | B2 | 4/2004 | Taga |
| 6,725,943 | B2 | 4/2004 | Ginell |
| 6,733,413 | B2 | 5/2004 | Lagarde et al. |
| 6,745,883 | B2 | 6/2004 | Eto et al. |
| 6,789,631 | B1 | 9/2004 | Realme, Sr. et al. |
| 6,814,152 | B2 | 11/2004 | Ginell |
| 6,843,326 | B2 | 1/2005 | Tambini |
| 6,857,983 | B2 | 2/2005 | Milbourne et al. |
| 6,860,341 | B2 | 3/2005 | Spielmann et al. |
| 6,883,619 | B1 | 4/2005 | Huang |
| 6,887,176 | B2 | 5/2005 | Sasaki |
| 6,889,778 | B2 | 5/2005 | Colangelo, III et al. |
| 6,918,325 | B2 | 7/2005 | Chan |
| 6,945,337 | B2 | 9/2005 | Kawai et al. |
| 6,983,810 | B2 | 1/2006 | Hara et al. |
| 6,984,188 | B2 | 1/2006 | Potter et al. |
| 7,028,784 | B2 | 4/2006 | Breitenmoser |
| 7,066,691 | B2 | 6/2006 | Doyle et al. |
| 7,101,300 | B2 | 9/2006 | Milbourne et al. |
| 7,124,839 | B2 | 10/2006 | Furuta et al. |
| 7,198,116 | B1 | 4/2007 | Chen |
| 7,201,235 | B2 | 4/2007 | Umemura et al. |
| 7,210,541 | B2 | 5/2007 | Miller |
| 7,220,211 | B2 | 5/2007 | Potter et al. |
| 7,223,195 | B2 | 5/2007 | Milbourne et al. |
| 7,234,536 | B2 | 6/2007 | Scholl et al. |
| 7,308,948 | B2 | 12/2007 | Furuta |
| 7,314,097 | B2 | 1/2008 | Jenner et al. |
| 7,331,404 | B2 | 2/2008 | Pusateri |
| 7,334,646 | B2 | 2/2008 | Hara et al. |
| 7,360,607 | B2 | 4/2008 | Aeberhard |
| 7,380,613 | B2 | 6/2008 | Furuta |
| 7,395,873 | B2 | 7/2008 | Nakamura et al. |
| 7,404,781 | B2 | 7/2008 | Milbourne et al. |
| 7,410,007 | B2 | 8/2008 | Chung et al. |
| 7,410,441 | B2 | 8/2008 | Milbourne et al. |
| 7,419,013 | B2 | 9/2008 | Sainomoto et al. |
| 7,438,140 | B2 | 10/2008 | Sterling et al. |
| 7,452,304 | B2 | 11/2008 | Hagan et al. |
| 7,455,121 | B2 | 11/2008 | Saito et al. |
| 7,455,123 | B2 | 11/2008 | Aeberhard |
| 7,469,753 | B2 | 12/2008 | Klemm et al. |
| 7,562,720 | B2 | 7/2009 | Seith et al. |
| 7,607,492 | B2 | 10/2009 | Seith et al. |
| 7,673,702 | B2 | 3/2010 | Johnson et al. |
| 8,887,831 | B2 * | 11/2014 | Zhang ..... B23B 39/00 173/216 |
| 2002/0005290 | A1 | 1/2002 | Giardino et al. |
| 2002/0035876 | A1 | 3/2002 | Donaldson, Jr. |
| 2002/0192043 | A1 | 12/2002 | Lin |
| 2004/0045729 | A1 | 3/2004 | Lehnert et al. |
| 2005/0028997 | A1 | 2/2005 | Hagan et al. |
| 2005/0263305 | A1 | 12/2005 | Shimizu et al. |
| 2005/0284265 | A1 | 12/2005 | Baker |
| 2006/0157262 | A1 | 7/2006 | Chen |
| 2006/0225903 | A1 | 10/2006 | Sterling et al. |
| 2006/0237205 | A1 * | 10/2006 | Sia et al. ..... 173/48 |
| 2007/0022846 | A1 | 2/2007 | Fryatt |
| 2007/0158090 | A1 | 7/2007 | Sterling et al. |
| 2008/0083303 | A1 | 4/2008 | Baker |
| 2008/0230245 | A1 | 9/2008 | Matsunaga |
| 2008/0308286 | A1 | 12/2008 | Puzio |
| 2009/0014193 | A1 | 1/2009 | Barezzani et al. |
| 2009/0020301 | A1 | 1/2009 | Aeberhard |
| 2009/0102407 | A1 * | 4/2009 | Klemm et al. ..... 318/432 |
| 2009/0173194 | A1 | 7/2009 | Chen |
| 2009/0250233 | A1 | 10/2009 | Wallace |
| 2010/0000749 | A1 | 1/2010 | Andel |
| 2010/0000750 | A1 | 1/2010 | Andel |
| 2010/0025063 | A1 | 2/2010 | Kuhnapfel et al. |
| 2010/0064864 | A1 | 3/2010 | Kobayashi |
| 2010/0071923 | A1 * | 3/2010 | Rudolph et al. ..... 173/48 |
| 2010/0071924 | A1 | 3/2010 | Schoeps |
| 2010/0101815 | A1 | 4/2010 | Kobayashi |
| 2010/0276168 | A1 | 11/2010 | Murthy et al. |

OTHER PUBLICATIONS

European Patent Office Extended Search Report for Application No. 11838556.6 dated Mar. 31, 2015 (4 pages).

* cited by examiner

IMPACT TOOL WITH ADJUSTABLE CLUTCH

CROSS-REFERENCE TO RELATED APPLICATIONS

This application claims priority to U.S. Provisional Patent Application No. 61/410,116 filed on Nov. 4, 2010, the entire contents of which are incorporated herein by reference.

FIELD OF THE INVENTION

The present invention relates to tools, and more particularly to power tools.

BACKGROUND OF THE INVENTION

Impact tools or wrenches are typically utilized to provide a striking rotational force, or intermittent applications of torque, to a tool element and workpiece (e.g., a fastener) to either tighten or loosen the fastener. Conventional pneumatic impact wrenches include at least two torque settings for rotating the output shaft of the impact wrench in a clockwise or tightening direction to permit the user of the impact wrench to adjust the amount of torque available at the output shaft during use. Such a feature is typically provided by a valve that meters the amount of air entering the air motor, which is directly proportional to the torque output achieved by the air motor.

SUMMARY OF THE INVENTION

The invention provides, in one aspect, an impact tool including a housing, a motor supported in the housing, an output shaft rotatably supported in the housing about a central axis, an impact mechanism coupled between the motor and the output shaft and operable to impart a striking rotational force to the output shaft, and a clutch mechanism coupled between the impact mechanism and the output shaft. The clutch mechanism is operable in a first mode, in which torque from the motor is transferred to the output shaft through the impact mechanism, and a second mode, in which torque from the motor is diverted from the output shaft toward a portion of the impact mechanism.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
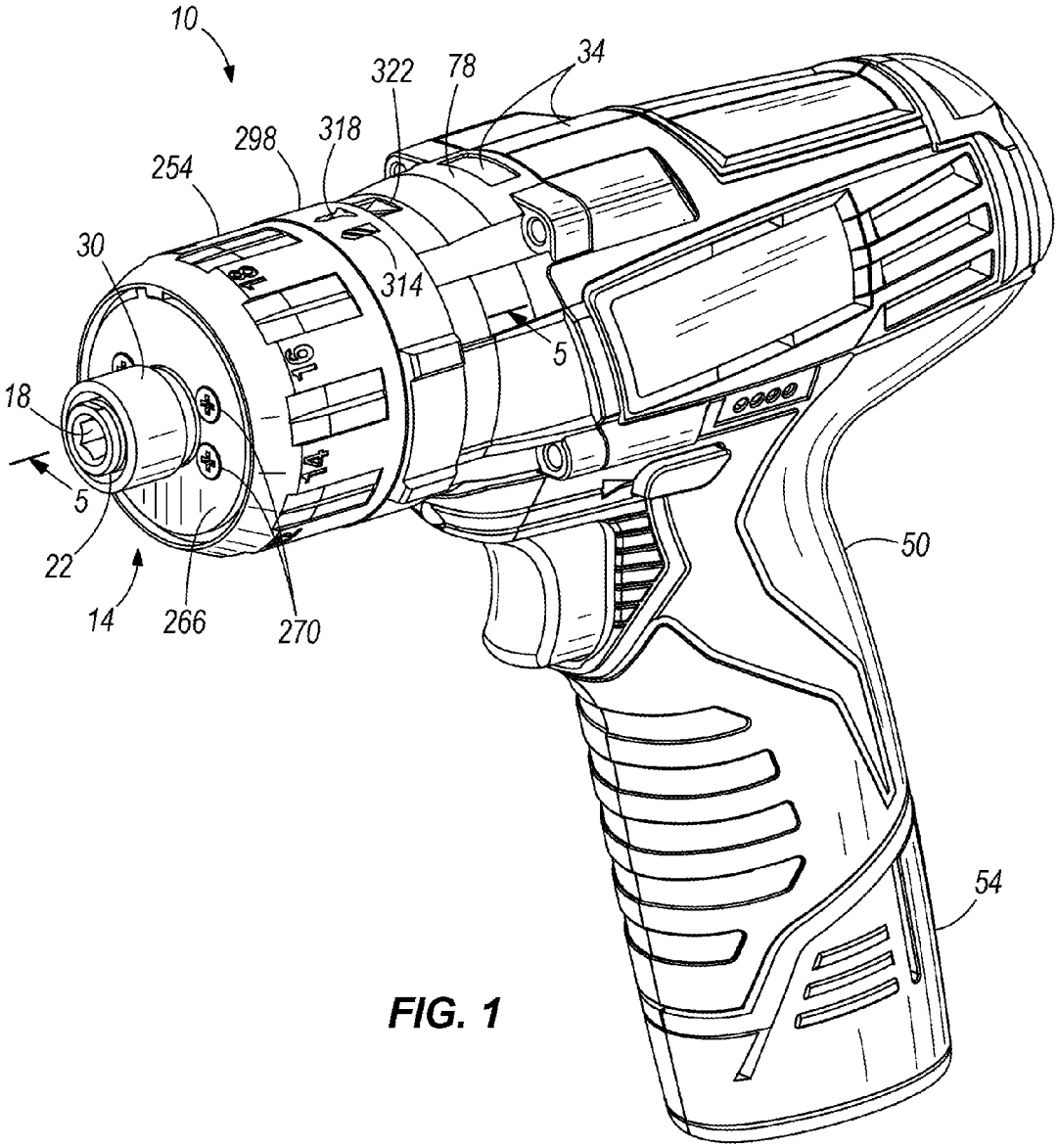
FIG. 1 is a front perspective view of an impact tool according to an embodiment of the invention.

FIG. 1 illustrates an impact tool 10 including a drive end 14 having a non-cylindrical receptacle or bore 18 within which a fastener or a tool bit may be received. In the illustrated construction of the tool 10, the non-cylindrical bore 18 includes a hexagonal cross-sectional shape. However, the non-cylindrical bore 18 may be shaped in any of the number of different ways to receive any of a number of different fasteners and/or tool bits. The drive end 14 includes an output shaft 22 having a detent 26 (FIG. 2) utilized to lock or axially secure the fastener and/or tool bit to the drive end 14 of the tool 10, a sleeve 30 positioned over the output shaft 22 for actuating the detent 26 between a locked and an unlocked configuration, and a biasing member (e.g., a compression spring, not shown) for biasing the sleeve 30 toward a position in which the detent 26 is in the locked configuration. Alternatively, the detent 26, the sleeve 30, and the spring may be omitted from the output shaft 22, such that the fastener and/or tool bit is not lockable to the drive end 14 of the tool 10.

Figure 2:
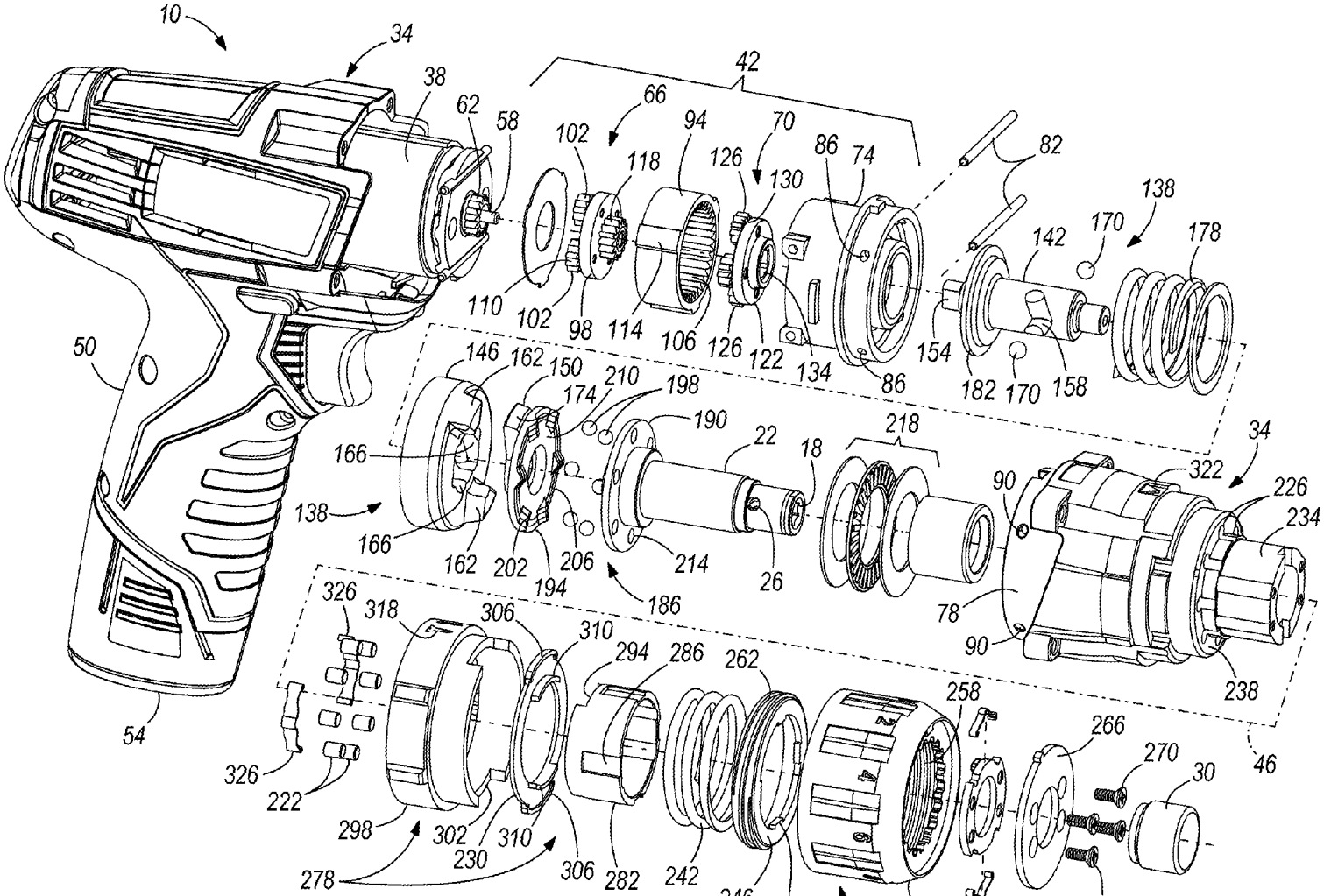
FIG. 2 is an exploded, front perspective view of the impact tool of FIG. 1.
Figure 3:
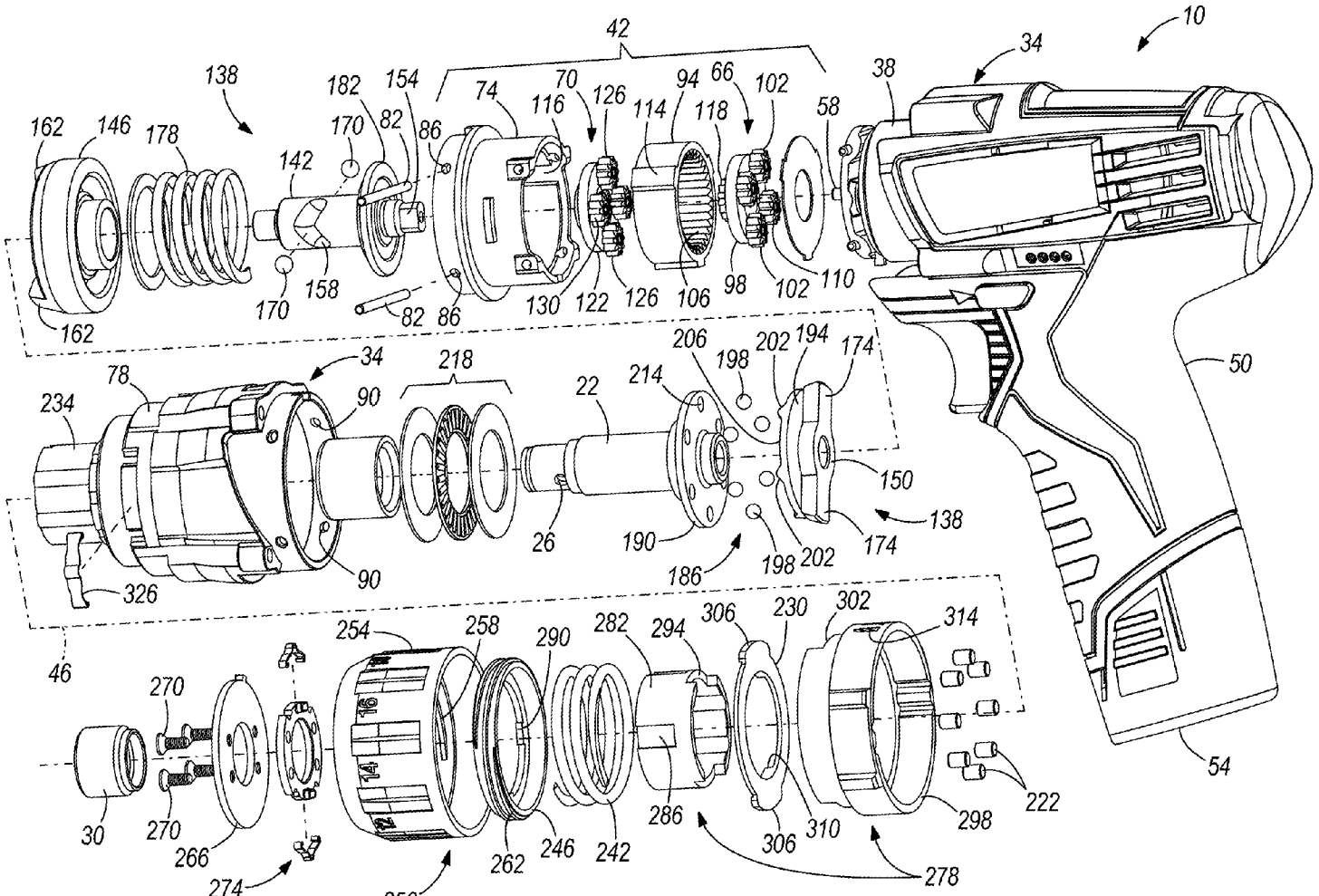
FIG. 3 is an exploded, rear perspective view of the impact tool of FIG. 1.

With reference to FIGS. 2 and 3, the impact tool 10 includes a housing 34, a motor 38 supported in the housing 34, and a transmission 42 operably coupled to the motor 38 to receive torque from the motor 38. The output shaft 22 is rotatable about a central axis 46 and operably coupled to the transmission 42 to receive torque from the transmission 42.

In the illustrated construction of the tool 10, the housing 34 includes a handle 50 in which a battery pack 54 is received. The battery pack 54 is electrically connected to the motor 38 (via a trigger-switch and microcontroller) to provide power to the motor 38. The battery pack 54 is a 12-volt power tool battery pack 54 and includes three lithium-ion battery cells. Alternatively, the battery pack 54 may include fewer or more battery cells to yield any of a number of different output voltages (e.g., 14.4 volts, 18 volts, etc.). Additionally or alternatively, the battery cells may include chemistries other than lithium-ion such as, for example, nickel cadmium, nickel metal-hydride, or the like. Alternatively, the battery pack 54 may be coupled to a different portion of the housing 34 (e.g., a motor support portion of the housing 34). As a further alternative, the tool 10 may include an electrical cord for connecting the motor 38 to a remote electrical source (e.g., a wall outlet).

The motor 38 is configured as a direct-current, can-style motor 38 having an output shaft 58 upon which a pinion 62 is fixed for rotation (FIG. 2). In the illustrated construction of the tool 10, the pinion 62 is interference or press-fit to the motor output shaft 58. Alternatively, the pinion 62 may be coupled for co-rotation with the motor output shaft 58 in any of a number of different ways (e.g., using a spline fit, a key and keyway arrangement, by welding, brazing, using adhesives, etc.). As a further alternative, the pinion 62 may be integrally formed as a single piece with the motor output shaft 58.

With reference to FIGS. 2 and 3, the transmission 42 includes two stages of speed reduction, including a first stage planetary transmission 66 and a second stage planetary transmission 70. The transmission 42 also includes a gear case 74 within which the first and second stage planetary transmissions 66, 70 are received. In the illustrated construction of the tool 10, the gear case 74 is secured to a front portion 78 (FIG. 1) of the housing 34 using a pair of pins 82 received in respective apertures 86, 90 in the gear case 74 and the front portion 78 of the housing 34. Alternatively, the gear case 74 and the front portion 78 of the housing 34 may be coupled in any of a number of different ways (e.g., using snap-fits, using adhesives, by welding, etc.).

With continued reference to FIGS. 2 and 3, the first stage planetary transmission 66 includes an outer ring gear 94, a carrier 98 rotatable about the central axis 46, and a plurality of planet gears 102 rotatably coupled to the carrier 98 about respective axes radially spaced from the central axis 46. The outer ring gear 94 includes a plurality of radially inwardly-extending teeth 106 that are engageable by corresponding teeth 110 on the planet gears 102. The outer ring gear 94 also includes a plurality of radially outwardly-extending protrusions 114, and the gear case 74 includes a corresponding plurality of slots 116 (FIG. 3) within which the protrusions 114 are received to rotationally fix the outer ring gear 94 to the gear case 74, and therefore the housing 34. Alternatively, the outer ring gear 94 may be fixed to the gear case 74 in any of a number of different ways (e.g., using snap-fits, an interference or press-fit, fasteners, adhesives, by welding, etc.) As a further alternative, the outer ring gear 94 may be integrally formed as a single piece with the gear case 74.

With reference to FIG. 2, the carrier 98 includes a sun gear 118 that is co-rotatable with the carrier 98 and the planet gears 102 about the central axis 46. In the illustrated construction of the tool 10, the sun gear 118 is integrally formed as a single piece with the carrier 98. Alternatively, the sun gear 118 may be a separate and distinct component from the carrier 98, and coupled to the carrier 98 for co-rotation with the carrier 98 in any of a number of different ways (e.g., using an interference or press-fit, fasteners, adhesives, by welding, etc.).

With reference to FIGS. 2 and 3, the second stage planetary transmission 70 includes a carrier 122 rotatable about the central axis 46, and a plurality of planet gears 126 rotatably coupled to the carrier 122 about respective axes radially spaced from the central axis 46. The outer ring gear 94 is shared between the first and second stage planetary transmissions 66, 70, such that the teeth 106 on the outer ring gear 94 are engaged with corresponding teeth 130 on the planet gears 126. With reference to FIG. 2, the carrier 122 includes an aperture 134 having a non-circular cross-sectional shape, the purpose of which is discussed below.

With continued reference to FIGS. 2 and 3, the tool 10 includes an impact mechanism 138 including a rotating shaft 142, a hammer 146 supported on the shaft 142 for rotation with the shaft 142, and an anvil 150. The end of the shaft 142 includes a projection 154 having a non-circular cross-sectional shape corresponding to that of the aperture 134 in the carrier 122. The projection 154 on the shaft 142 is received within the aperture 134 such that the shaft 142 and the carrier 122 co-rotate at all times. Alternatively, the shaft 142 may be non-rotatably coupled to the carrier 122 in any of a number of different ways.

The shaft 142 includes two V-shaped cam grooves 158 equally spaced from each other about the outer periphery of the shaft 142. Each of the cam grooves 158 includes a segment that is inclined relative to the central axis 46. The hammer 146 has opposed lugs 162 and two cam grooves 166 equally spaced from each other about an inner periphery of the hammer 146. Like the cam grooves 158 in the shaft 142, each of the cam grooves 166 is inclined relative to the central axis 46. The respective pairs of cam grooves 158, 166 in the shaft 142 and the hammer 146 are in facing relationship such that an engagement member (e.g., a ball 170) is received within each of the pairs of cam grooves 158, 166. The balls 170 and cam grooves 158, 166 effectively provide a cam arrangement between the shaft 142 and the hammer 146 for transferring torque between the shaft 142 and the hammer 146 between consecutive impacts of the lugs 162 upon corresponding lugs 174 on the anvil 150 (FIG. 3). The impact mechanism 138 also includes a compression spring 178 positioned between the hammer 146 and a retainer 182 of the rotating shaft 142 to bias the hammer 146 toward the anvil 150. U.S. Pat. No. 6,733,413, the entire contents of which is incorporated herein by reference, discloses an impact mechanism similar to the impact mechanism 138 disclosed in the present application.

With reference to FIGS. 2 and 3, the tool 10 also includes a clutch mechanism 186 operable to selectively divert torque output by the motor 38 away from the output shaft 22 and toward a portion of the impact mechanism 138 when a reaction torque on the output shaft 22 exceeds a predetermined torque setting of the clutch mechanism 186 (e.g., a reaction torque provided by a fastener and/or tool bit coupled to the drive end 14 of the tool 10). The clutch mechanism 186 includes a first plate 190 coupled for co-rotation with the output shaft 22, a second plate 194 coupled for co-rotation with the anvil 150, and a plurality of engagement members (e.g., balls 198) between the first and second plates 190, 194 through which torque and a rotational striking force are transferred from the anvil 150 to the output shaft 22 when the clutch mechanism 186 is engaged. In the illustrated construction of the tool 10, the first plate 190 is integrally formed as a single piece with the output shaft 22, and the second plate 194 is integrally formed as a single piece with the anvil 150. Alternatively, either of the first and second plates 190, 194 may be formed separately from the output shaft 22 and the anvil 150, respectively, and secured to the output shaft 22 and anvil 150 in any of a number of different ways (e.g., using an interference or press-fit, fasteners, adhesives, by welding, etc.).

Figure 5:
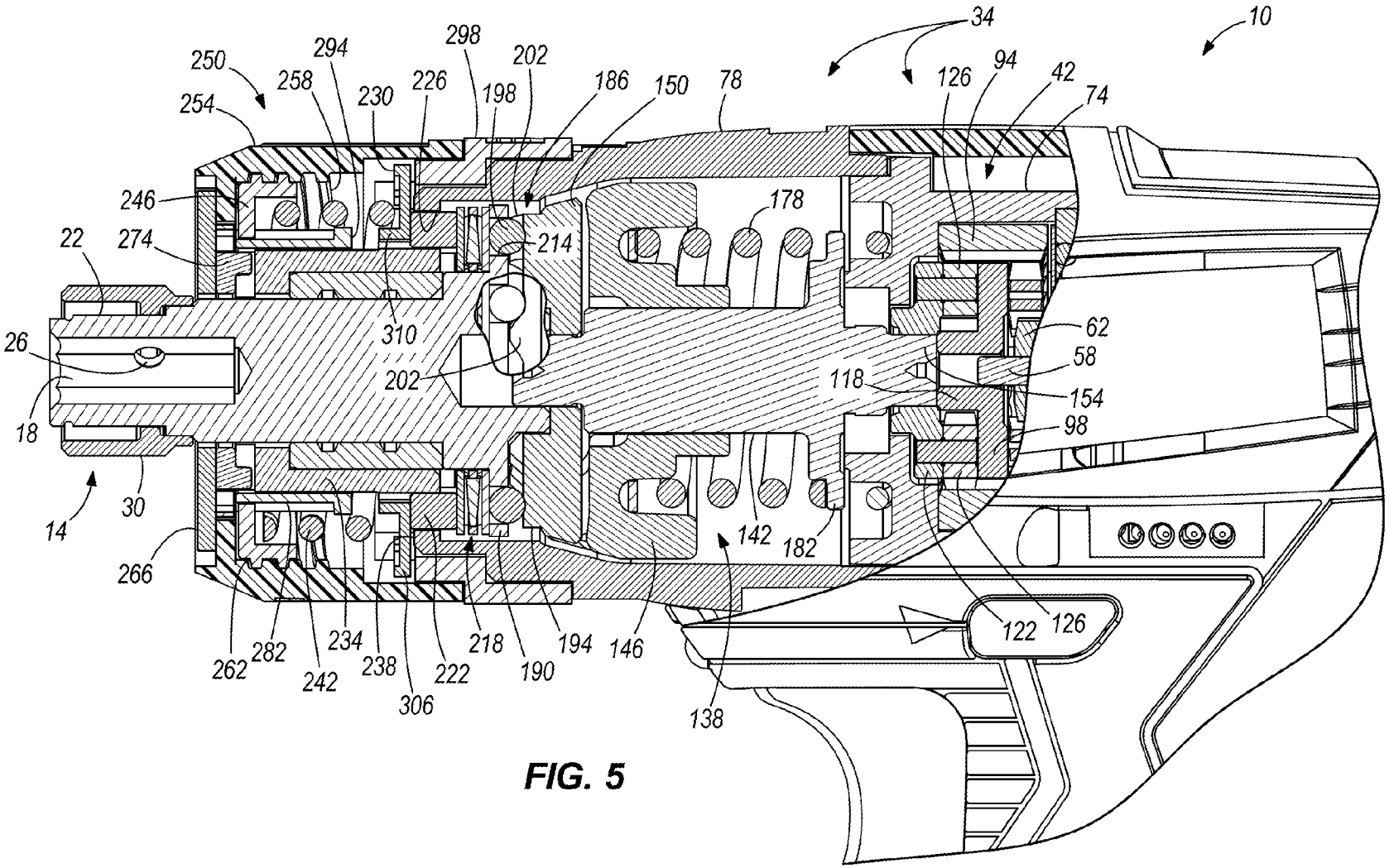
FIG. 5 is a partial cross-sectional view of the impact tool of FIG. 1 along line 5-5 in FIG. 1, illustrating a clutch mechanism in an engaged configuration.

With reference to FIG. 2, the second plate 194 includes axially extending protrusions 202 spaced about the central axis 46. Grooves 206 are defined in an end face 210 of the second plate 194 by adjacent protrusions 202 in which the balls 198 are respectively received. The first plate 190 includes apertures 214 radially spaced from the central axis 46. As shown in FIG. 5, the balls 198 are at least partially positioned within the respective apertures 214 in the first plate 190 and are at least partially received within the respective grooves 206 in the end face 210 of the second plate 194.

With reference to FIGS. 2 and 3, the clutch mechanism 186 also includes a thrust bearing assembly 218 and cylindrical pins 222 disposed within corresponding apertures 226 in the front portion 78 of the housing 34 radially spaced about the central axis 46. The pins 222 are engaged with the respective balls 198 via the thrust bearing assembly 218 such that the pins 222, the thrust bearing assembly 218, and balls 198 move together in a direction parallel to the central axis 46 relative to the respective apertures 214, 226 in the first plate 190 and the front housing portion 78 during operation of the tool 10 when the clutch mechanism 186 is enabled.

With reference to FIGS. 2 and 3, the clutch mechanism 186 also includes a washer 230 supported on a nose 234 of the front housing portion 78 coaxial with the central axis 46. The washer 230 is positioned adjacent an axially-facing, exterior face 238 of the front housing portion 78, such that the cylindrical pins 222 disposed within the apertures 226 in the front housing portion 78 are engaged with the washer 230. The clutch mechanism 186 further includes a resilient member (e.g., a compression spring 242) positioned over the nose 234 of the front housing portion 78. The spring 242 is positioned between the washer 230 and a spring retainer 246, which is described in more detail below. The spring 242 is operable to bias the washer 230 toward the exterior face 238 of the front housing portion 78.

With continued reference to FIGS. 2 and 3, the tool 10 also includes a clutch mechanism adjustment assembly 250, of which the spring retainer 246 is also a component, including an adjustment ring or collar 254 threaded to the spring retainer 246. Particularly, the collar 254 includes a threaded inner periphery 258, and the spring retainer 246 includes a corresponding threaded outer periphery 262. Accordingly, relative rotation between the collar 254 and the spring retainer 246 also results in translation of the spring retainer 246 relative to the collar 254 to adjust the preload of the spring 242. The collar 254 is axially secured relative to the front housing portion 78 by a plate 266 which, in turn, is secured to an end of the front housing portion 78 by a plurality of fasteners 270. The plate 266, however, permits the collar 254 to rotate relative to the front housing portion 78. The clutch mechanism adjustment assembly 250 also includes a detent assembly 274 operable to hold the collar 254 in different rotational positions relative to the front housing portion 78 corresponding with different preload values of the spring 242. As is described in more detail below, the clutch mechanism adjustment assembly 250 is operable to set the particular torque at which the clutch mechanism 186 slips.

The tool 10 further includes a mode selection mechanism 278 including a sleeve 282 coupled to the nose 234 of the front housing portion 78. In the illustrated construction of the tool 10, the sleeve 282 is interference-fit to the nose 234. Alternatively, the sleeve 282 may be secured to the nose 234 in any of a number of different ways (e.g., using fasteners, adhesives, by welding, etc.). The sleeve 282 includes axially extending slots 286 in the outer peripheral surface of the sleeve 282 in which respective radially inwardly extending tabs 290 of the spring retainer 246 are received. Therefore, the spring retainer 246 is prevented from rotating relative to the front housing portion 78, yet permitted to translate relative to the front housing portion 78 in response to rotation of the collar 254. The sleeve 282 also includes opposed slots 294 in an end of the sleeve 282 in facing relationship with the washer 230, the purpose of which is discussed in detail below.

The mode selection mechanism 278 also includes a mode selection ring 298 coaxially mounted to the front housing portion 78 for rotation relative to the front housing portion 78. In the illustrated construction of the tool 10, the mode selection ring 298 is sandwiched between the collar 254 and a flange on the front housing portion 78 (FIG. 5). Alternatively, the mode selection ring 298 may be positioned remotely from the collar 254 on another location of the tool 10. With reference to FIG. 2, the mode selection ring 298 includes opposed slots 302 in which corresponding radially outwardly extending tabs 306 of the washer 230 are received. As such, the mode selection ring 298 and the washer 230 are co-rotatable relative to the front housing portion 78.

Figure 4:
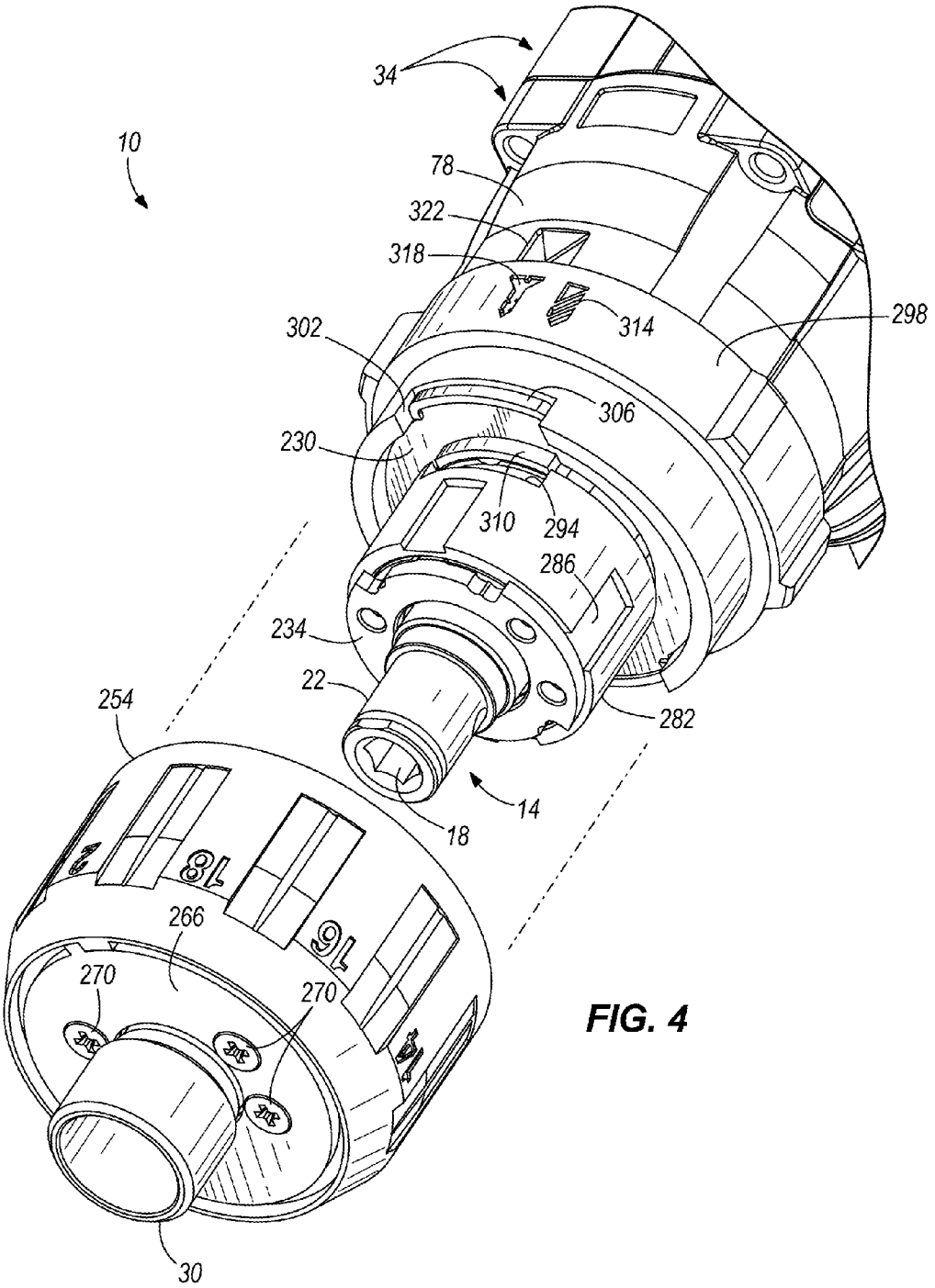
FIG. 4 is a partially exploded, front perspective view of the impact tool of FIG. 1, illustrating the impact tool in driver mode.

The washer 230 also includes opposed axially extending tabs 310 that are selectively received within the slots 294 in the sleeve 282. Particularly, the washer 230 is rotatable between a first position (FIG. 7) in which the tabs 310 are inhibited from being received within the respective slots 294, and a second position (FIG. 4) in which the tabs 310 are aligned with the respective slots 294 and receivable within the respective slots 294. Consequently, the clutch mechanism 186 is locked out or disabled when the washer 230 is rotated to the first position, and the clutch mechanism 186 is enabled when the washer 230 is rotated to the second position.

With reference to FIG. 1, the mode selection ring 298 includes icons 314, 318 that provide a visual indication to the user of the tool 10 when the washer 230 is in the first and second positions. Specifically, when aligned with a marking 322 on the front housing portion 78, the icon 314 communicates to the user of the tool 10 that the washer 230 is in the first position to lock out or disable the clutch mechanism 186. Likewise, when aligned with the marking 322 on the front housing portion 78, the icon 318 communicates to the user of the tool 10 that the washer 230 is in the second position to enable the clutch mechanism 186. The mode selection mechanism 278 also includes detents 326 that provide a tactile indicator that the mode selection ring 298 and washer 230 have been rotated between the first and second positions to disable or enable the clutch mechanism 186. In the illustrated construction of the tool 10, the icon 318 is configured as a fastener suggestive of a driver mode of the tool 10 in which the clutch mechanism 186 is enabled, while the icon 314 is configured as a drill bit suggestive of a drill mode of the tool 10 in which the clutch mechanism 186 is disabled. Alternatively, the icons 314, 318 may be configured in any of a number of different ways.

In operation of the tool 10 when the clutch mechanism 186 is enabled (FIGS. 4-6), the shaft 142 and hammer 146 initially co-rotate in response to activation of the motor 38. Upon the first impact between the respective lugs 162, 174 of the hammer 146 and anvil 150, the anvil 150 and the output shaft 22 are rotated at least an incremental amount provided the reaction torque on the output shaft 22 is less than the torque setting of the clutch mechanism 186. Then, the hammer 146 ceases rotation relative to the front housing portion 78; however, the shaft 142 continues to be rotated by the motor 38. Continued relative rotation between the hammer 146 and the shaft 142 causes the hammer 146 to displace axially away from the anvil 150 against the bias of the spring 178.

As the hammer 146 is axially displaced relative to the shaft 142, the hammer lugs 162 are also displaced relative to the anvil 150 until the hammer lugs 162 are clear of the anvil lugs 174. At this moment, the compressed spring 178 rebounds, thereby axially displacing the hammer 146 toward the anvil 150 and rotationally accelerating the hammer 146 relative to the shaft 142 as the balls 170 move within the pairs of cam grooves 158, 166 back toward their pre-impact position. The hammer 146 reaches a peak rotational speed, then the next impact occurs between the hammer 146 and the anvil 150. In this manner, the fastener and/or tool bit received in the drive end 14 is rotated relative to a workpiece in incremental amounts until the fastener is sufficiently tight or loosened relative to the workpiece.

In operation of the tool 10 when the clutch mechanism 186 is enabled and the reaction torque on the output shaft 22 is less than the torque setting of the clutch mechanism 186 (i.e., as determined by the rotational position of the collar 254 and the amount of preload on the spring 242), the clutch mechanism 186 is operable in a first mode in which torque from the motor 38 is transferred through the transmission 42 and the impact mechanism 138, and to the output shaft 22 to continue driving the fastener and/or tool bit received in the drive end 14. Specifically, when the reaction torque on the output shaft 22 is less than the torque setting of the clutch mechanism 186, the spring 242 biases the washer 230, the cylindrical pins 222, the thrust bearing assembly 218, and the balls 198 toward the second plate 194, causing the balls 198 to remain in the grooves 206 in the end face 210 of the second plate 194 and jam against the protrusions 202 on the second plate 194 (FIG. 5). As a result, the second plate 194 and the anvil 150 are prevented from rotating relative to the first plate 190 and the output shaft 22.

Figure 6:
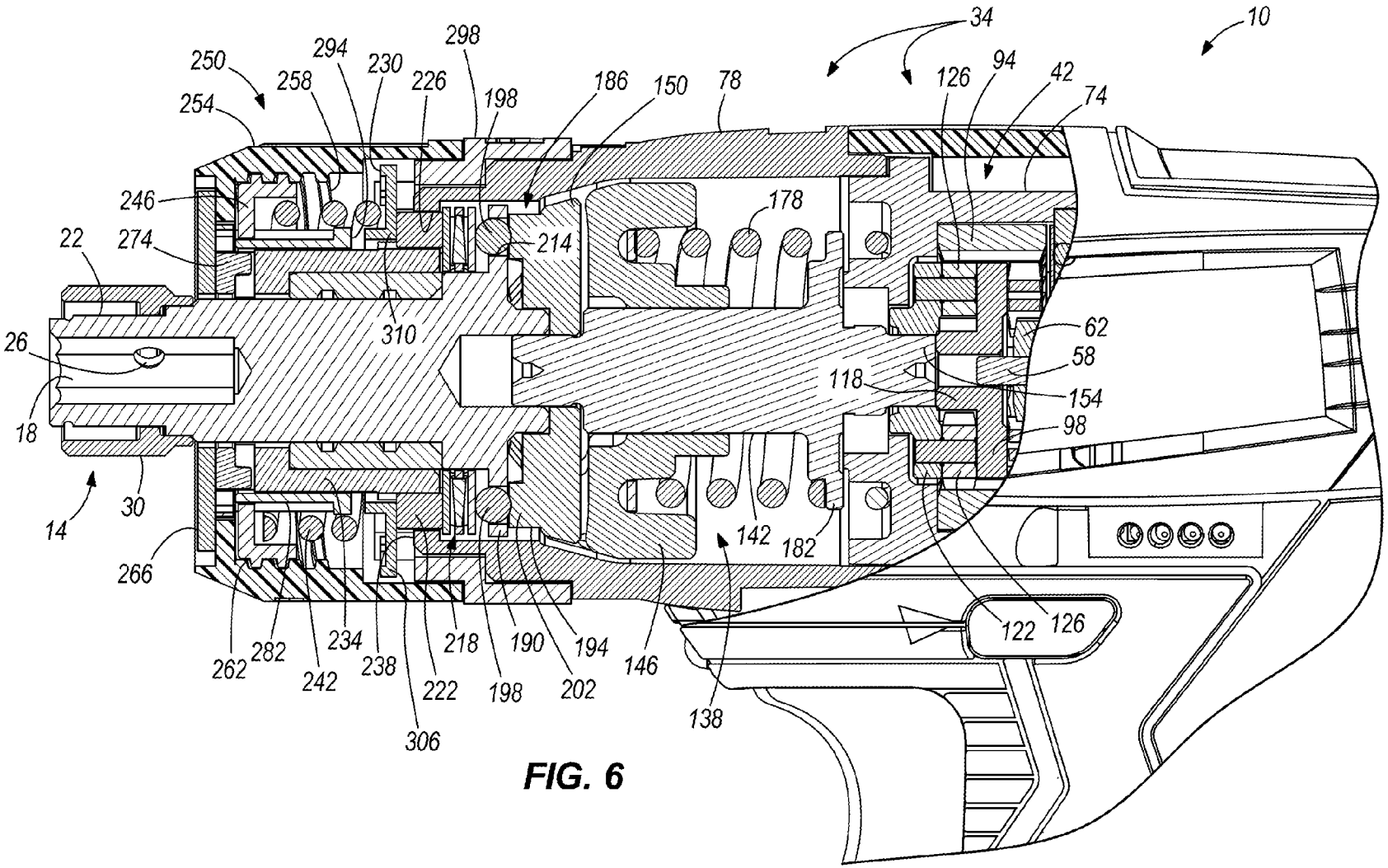
FIG. 6 is a partial cross-sectional view of the impact tool of FIG. 5, illustrating the clutch mechanism in a disengaged configuration.

However, when the reaction torque on the output shaft 22 reaches the torque setting of the clutch mechanism 186, the clutch mechanism 186 is operable in a second mode in which torque from the motor 38 is diverted from the output shaft 22 toward the second plate 194 and the anvil 150. Specifically, when the reaction torque on the output shaft 22 reaches the torque setting of the clutch mechanism 186, the frictional force exerted on the second plate 194 by the balls 198 jammed against the protrusions 202 is no longer sufficient to prevent the second plate 194 from rotating or slipping relative to the first plate 190, ceasing torque transfer to the output shaft 22. As the anvil 150 and the second plate 194 continue rotation relative to the first plate 190 and the output shaft 22, the balls 198 ride up and over the respective protrusions 202 on the second plate 194, causing the thrust bearing assembly 218, the cylindrical pins 222, and the washer 230 to be displaced axially away from the anvil 150 against the bias of the spring 242 (FIG. 6). The anvil 150 and the second plate 194 will continue to slip or rotate relative to the first plate 190 and the output shaft 22, causing the balls 198 to ride up and over the protrusions 202, so long as the reaction torque on the output shaft 22 exceeds the torque setting of the clutch mechanism 186.

Should the user of the tool 10 decide to adjust the tool 10 to a higher torque setting, the user would grasp the collar 254 and rotate the collar 254 toward a higher torque setting, causing the spring retainer 246 to be displaced along the sleeve 282 toward the washer 230 to increase the preload of the spring 242. The detent assembly 274 would provide tactile feedback to the user of the tool 10 as the collar 254 is rotated between adjacent torque settings.

Figure 7:
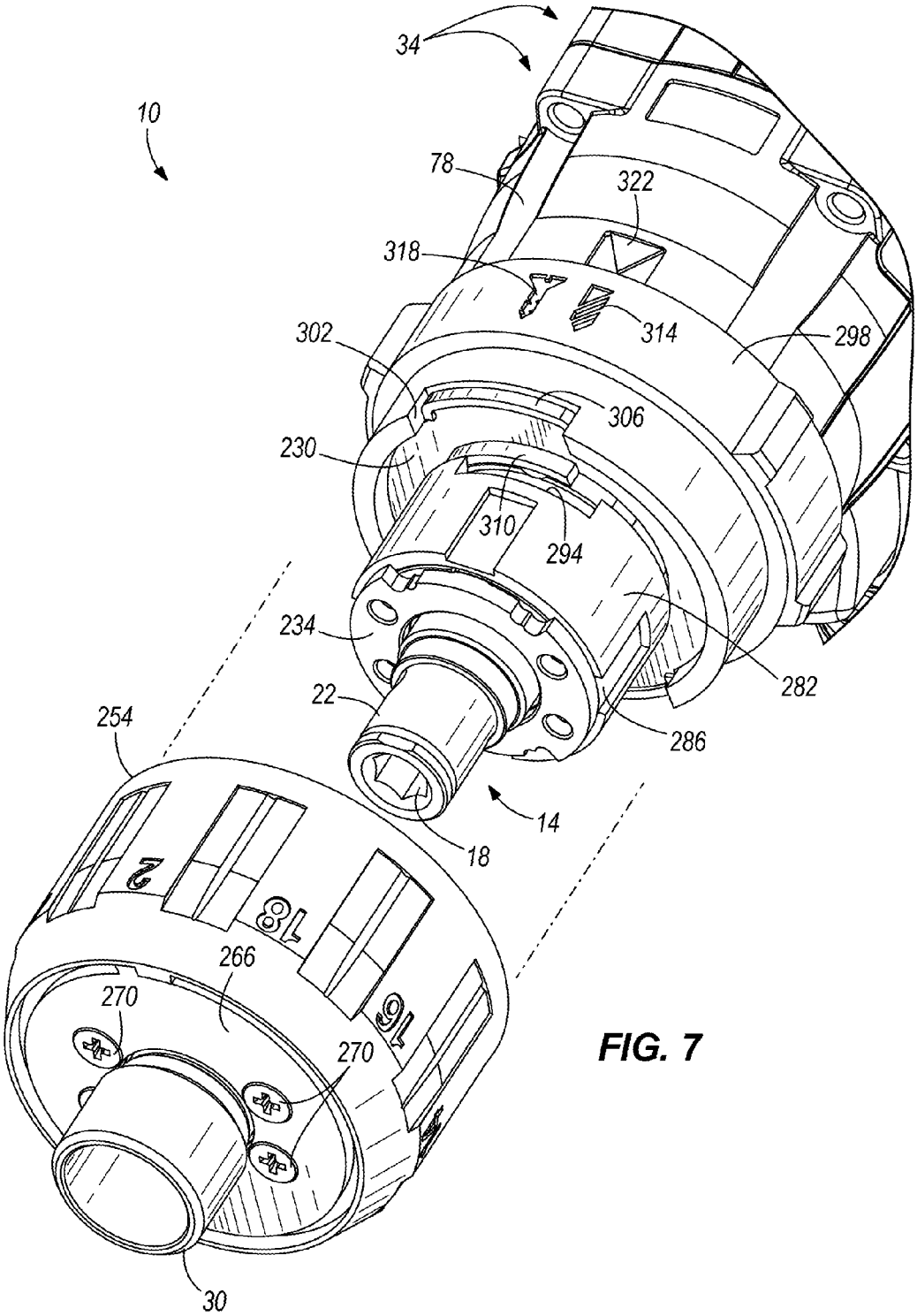
FIG. 7 is a partially exploded, front perspective view of the impact tool of FIG. 1, illustrating the impact tool in drill mode.
Figure 8:
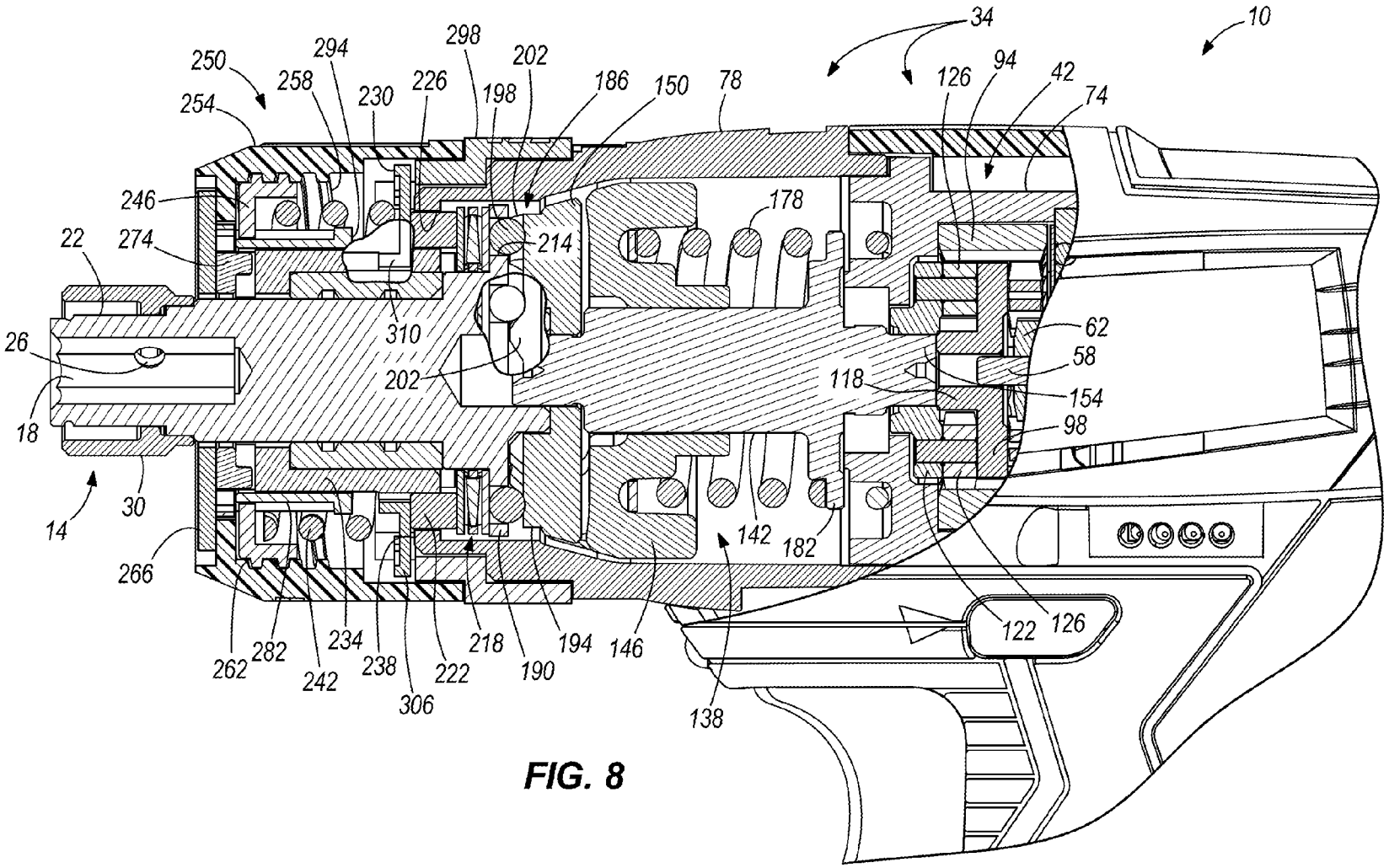
FIG. 8 is a partial cross-sectional view of the impact tool of FIG. 5, illustrating the clutch mechanism in a locked-out configuration.

Should the user of the tool 10 decide to adjust the tool 10 to disable the clutch mechanism 186 to operate the tool 10 in a drill mode, the user would grasp the mode selection ring 298 and rotate the ring 298 from the clutch enable setting toward the drill mode setting as indicated by the drill mode icon 314 (FIG. 7). Because the mode selection ring 298 and washer 230 are coupled for co-rotation as described above, rotation of the mode selection ring 298 toward the drill mode setting also causes the washer 230 to rotate relative to the sleeve 282 which, in turn, misaligns the tabs 310 and the slots 302 on the washer 230 and sleeve 282, respectively. Accordingly, prior to the balls 198 riding up and over the protrusions 202 on the second plate 194 as the reaction torque on the output shaft 22 approaches the torque setting of the clutch mechanism 186, the washer 230 engages the end of the sleeve 282, thereby preventing the washer 230 from being displaced farther from the second plate 194 and anvil 150 (FIG. 8). The balls 198, therefore, remain jammed against the protrusions 202 on the second plate 194 such that rotation or slipping of the second plate 194 relative to the first plate 190 is inhibited. When the clutch mechanism 186 is disabled, the full torque of the motor 38 may be transferred to the output shaft 22.

Various features of the invention are set forth in the following claims.

What is claimed is:

1. An impact tool comprising:

a housing;

a motor supported in the housing;

an output shaft rotatably supported in the housing about a central axis;

an impact mechanism coupled between the motor and the output shaft and operable to impart a striking rotational force to the output shaft; and a clutch mechanism coupled between the impact mechanism and the output shaft;

wherein the clutch mechanism is operable in a first mode, in which torque from the motor is transferred to the output shaft through the impact mechanism, and a second mode, in which torque from the motor is diverted from the output shaft toward a portion of the impact mechanism at a predetermined torque setting of the clutch mechanism.

2. The impact tool of claim 1, wherein the impact mechanism includes an anvil rotatably supported in the housing, and a hammer coupled to the motor to receive torque from the motor and impart the striking rotational force to the anvil.

3. The impact tool of claim 2, wherein the clutch mechanism includes a first plate coupled for co-rotation with the output shaft, a second plate coupled for co-rotation with the anvil, and a plurality of engagement members between the first and second plates through which torque and the striking rotational force are transferred when the clutch mechanism is operable in the first mode.

4. The impact tool of claim 3, wherein the second plate includes a plurality of axially extending protrusions spaced about the central axis, and wherein the engagement members are wedged against the protrusions when the clutch mechanism is operable in the first mode.

5. The impact tool of claim 4, wherein the engagement members are configured to ride over the protrusions in response to rotation of the second plate and the anvil relative to the first plate when the clutch mechanism is operable in the second mode.

6. The impact tool of claim 3, wherein the first plate includes a plurality of apertures, and wherein the engagement members are at least partially positioned within the respective apertures.

7. The impact tool of claim 3, wherein the clutch mechanism further includes a spring configured to impart a biasing force on the engagement members, and a washer positioned between the engagement members and the spring.

8. The impact tool of claim 7, wherein the clutch mechanism further includes a thrust bearing assembly positioned between the engagement members and the washer, and wherein the thrust bearing assembly is operable to permit relative rotation between the first plate and the washer.

9. The impact tool of claim 8, wherein the housing includes a plurality of apertures, wherein the clutch mechanism includes a corresponding plurality of cylindrical pins received within the apertures, and wherein the pins are positioned between the thrust bearing assembly and the washer.

10. The impact tool of claim 7, further comprising a clutch mechanism adjustment assembly including an adjustment ring rotatable in a first direction in which the spring is compressed to increase the biasing force imparted on the engagement members, and in a second direction in which the spring is permitted to expand to decrease the biasing force imparted on the engagement members.

11. The impact tool of claim 7, further comprising a mode selection mechanism including a sleeve coupled to a nose portion of the housing and having a slot defined therein, wherein the washer is rotatable between a first position in which a tab on the washer is inhibited from being received within the slot, and a second position in which the tab is receivable within the slot.

12. The impact tool of claim 11, wherein the mode selection mechanism includes a mode selection ring coupled for co-rotation with the washer.

13. The impact tool of claim 11, wherein the clutch mechanism is operable only in the first mode when the washer is rotated to the first position, and wherein the clutch mechanism is operable in the first and second modes when the washer is rotated to the second position.

14. The impact tool of claim 2, wherein the impact mechanism further includes a rotating shaft that receives torque from the motor, and an engagement member positioned between the hammer and the rotating shaft for transferring torque from the rotating shaft to the hammer.

15. The impact tool of claim 14, wherein the rotating shaft includes a first cam groove in which the engagement member is at least partially positioned, wherein the hammer includes a second cam groove in which the engagement member is at least partially positioned, and wherein the engagement member imparts axial displacement to the hammer in response to relative rotation between the rotating shaft and the hammer.

16. The impact tool of claim 14, further comprising a transmission positioned between the motor and the rotating shaft.

17. The impact tool of claim 16, wherein the transmission includes at least one planetary stage having an output carrier, wherein the impact tool further includes a projection coupled for co-rotation with one of the rotating shaft and the output carrier, and an aperture disposed in the other of the rotating shaft and the output carrier in which the projection is received.

18. The impact tool of claim 17, wherein the projection and the aperture have corresponding non-circular cross-sectional shapes to couple the output carrier and the rotating shaft for co-rotation.

19. The impact tool of claim 1, wherein the output shaft includes a hexagonal receptacle in which a tool bit is removably received.

20. The impact tool of claim 1, further comprising a battery electrically connected to the motor for powering the motor.

* * * * *